US007965042B2

(12) United States Patent
Kakisaka et al.

(10) Patent No.: US 7,965,042 B2
(45) Date of Patent: Jun. 21, 2011

(54) METAL HALIDE LAMP AND LIGHTING APPARATUS USING THE SAME

(75) Inventors: Shunsuke Kakisaka, Osaka (JP); Masahito Yoshida, Osaka (JP)

(73) Assignee: Panasonic Corporation, Osaka (JP)

( * ) Notice: Subject to any disclaimer, the term of this patent is extended or adjusted under 35 U.S.C. 154(b) by 155 days.

(21) Appl. No.: 12/277,843

(22) Filed: Nov. 25, 2008

(65) Prior Publication Data

US 2009/0085484 A1 Apr. 2, 2009

Related U.S. Application Data

(63) Continuation of application No. 10/598,006, filed as application No. PCT/JP2005/010268 on Jun. 3, 2005, now abandoned.

(30) Foreign Application Priority Data

Jun. 29, 2004 (JP) ..... 2004-190698

(51) Int. Cl.
*H01J 17/16* (2006.01)

(52) U.S. Cl. ..... 313/634; 313/25; 313/638

(58) Field of Classification Search ..... 313/634, 313/638, 25

See application file for complete search history.

(56) References Cited

U.S. PATENT DOCUMENTS

| | | | | |
|---|---|---|---|---|
| 4,620,125 | A * | 10/1986 | Keeffe et al. | 313/25 |
| 4,709,184 | A * | 11/1987 | Keeffe et al. | 313/638 |
| 4,791,334 | A * | 12/1988 | Keeffe et al. | 313/25 |
| 4,888,517 | A * | 12/1989 | Keeffe et al. | 313/25 |
| 5,023,506 | A | 6/1991 | Canale et al. | |
| 5,075,586 | A | 12/1991 | Jaeger et al. | |
| 5,296,779 | A | 3/1994 | Muzeroll | |
| 5,446,336 | A | 8/1995 | Gleixner et al. | |
| 5,610,469 | A | 3/1997 | Bergman et al. | |
| 6,137,229 | A | 10/2000 | Nishiura et al. | |
| 2003/0141797 | A1 | 7/2003 | Isida et al. | |

FOREIGN PATENT DOCUMENTS

| | | |
|---|---|---|
| CN | 1213155 | 4/1999 |
| DE | 298 17 632 | 2/2000 |
| GB | 750863 | 6/1956 |
| JP | 8-236087 | 9/1996 |
| JP | 11-191388 | 7/1999 |
| JP | 2003-331781 | 11/2003 |
| JP | 2005-203309 | 7/2005 |

* cited by examiner

*Primary Examiner* — Nimeshkumar D Patel
*Assistant Examiner* — Mary Ellen Bowman
(74) *Attorney, Agent, or Firm* — Hamre, Schumann, Mueller & Larson, P.C.

(57) ABSTRACT

A metal halide lamp according to the present invention includes: an outer tube 2; an inner tube 3 that is provided in the outer tube 2, has a sealing portion 10 in at least one end portion, and is made of quartz glass; an inner tube 3 provided in the outer tube 2; and an arc tube 4 provided in the inner tube 3, wherein assuming that the outer tube 2 has a maximum outer diameter A (mm), the inner tube 3 has a maximum outer diameter B (mm), and the metal halide lamp 1 consumes P (W) of power, the following relationships are satisfied:

$$0.06P+15.8 \leqq A \leqq 25,$$

$$0.05P+9.0 \leqq B, \text{ and}$$

$$1.14 \leqq A/B,$$

where P satisfies 20 W≦P≦130 W.

5 Claims, 3 Drawing Sheets

METAL HALIDE LAMP AND LIGHTING APPARATUS USING THE SAME

CROSS-REFERENCE TO RELATED APPLICATION

This application is a Continuation of application Ser. No. 10/598,006, filed Aug. 15, 2006, which is a U.S. National Stage of PCT/JP2005/010268, filed Jun. 3, 2005 which applications are incorporated herein by reference.

TECHNICAL FIELD

The present invention relates to a metal halide lamp and a lighting apparatus using the same.

BACKGROUND ART

Conventionally, known metal halide lamps as a light source for use in stores and the like have a triple-tube structure in which an arc tube, an inner tube surrounding the arc tube, and an outer tube surrounding the inner tube are provided such that the longitudinal central axes of the respective tubes are substantially coincident with each other (see, for example, Patent document 1). The arc tube is provided with a pair of electrodes therein, and is filled with a metal halide (light emitting metal), mercury, and inert gas.

The inner tube has a tip-off portion as a remaining part of an exhaust pipe in one end portion thereof, and has a sealing portion formed of a collapsed open end portion in the other end portion. Further, a space inside the inner tube is maintained under vacuum or is filled with nitrogen gas.

The inner tube frequently is made of quartz glass with an ultraviolet protection property to which cerium (Ce) or titanium (Ti), for example, is added to block ultraviolet rays emitted from the arc tube.

One end portion of the outer tube is closed in a substantially hemispherical shape, and a stem is adhered to the inside of the outer tube in the other end portion. Further, a base is attached to the outside of the outer tube in the other end portion. Stem lines are adhered to the inside of the stem. One end portion of the stem lines is connected electrically to the base, and the other end portion thereof is introduced into the outer tube to hold the inner tube and supply power to the electrodes.

The outer tube frequently is made of high-shock-resistant hard glass so that it is not damaged easily even if shattered pieces of the arc tube collide with the outer tube or an external shock is applied to the outer tube during transport.

The metal halide lamp having the triple-tube structure ensures excellent safety since the outer tube is not damaged easily even if the arc tube is destroyed. Therefore, this metal halide lamp is suitable for use in combination with a bottom-surface-open-type lighting unit equipped with no front glass or the like.

A bottom-surface-open-type lighting unit is used as a lighting unit for spotlight. A lighting unit for spotlight for use in stores and the like is required to be remarkably compact in size. For this reason, a halogen lamp, which is more compact than a metal halide lamp, has been used as a light source to be incorporated into a lighting unit for spotlight for use in stores and the like.

However, metal halide lamps are more efficient and have a longer life than halogen lamps. Thus, it has been demanded to use a metal halide lamp instead of a halogen lamp as a light source to be incorporated into a bottom-surface-open-type lighting unit for spotlight. Among metal halide lamps, a ceramic metal halide lamp in which an arc tube includes an envelope composed of translucent ceramic is expected as an alternative to a halogen lamp. For example, in the case of a ceramic metal halide lamp that consumes 20 W or 35 W of power, an arc tube is remarkably compact (for example, having a maximum outer diameter of 4 mm to 6 mm and an entire length of 25 mm to 35 mm), and yet it is possible to deliver luminance equal to that of a halogen lamp with about ⅓ the power consumed by the halogen lamp.

Patent document 1: JP 8 (1996)-236087 A

DISCLOSURE OF INVENTION

Problem to be Solved by the Invention

However, the conventional metal halide lamp is less compact when taken as a whole lamp. This problem is caused by the triple-tube structure of the lamp, a complex support structure of the arc tube, and the like. Even if this metal halide lamp is made as compact as possible, a reaction occurs between the ceramic composing the envelope and a filling material (light emitting metal) due to an increased temperature of the arc tube during lighting, whereby the vapor pressure, the composition ratio, and the like of the filling material are changed. As a result, desired lamp characteristics are not obtained. For the reasons above, little consideration has been made to apply a metal halide lamp to a lighting unit required to be remarkably compact, such as, in particular, a bottom-surface-open-type lighting unit for spotlight. Consequently, a lighting apparatus having a bottom-surface-open-type lighting unit for spotlight that is compact in size and uses a metal halide lamp as a light source has yet to be in practical use.

The present invention provides a safe and compact metal halide lamp that has desired lamp characteristics and is available as a light source to be incorporated into a bottom-surface-open-type lighting unit for spotlight, for example.

Further, the present invention provides a safe and compact lighting apparatus suitable for a spotlight, for example.

Means for Solving Problem

A metal halide lamp according to the present invention includes: an outer tube; an inner tube that is provided in the outer tube, has a sealing portion in at least one end portion, and is made of quartz glass; and an arc tube provided in the inner tube, wherein assuming that the outer tube has a maximum outer diameter A (mm), the inner tube has a maximum outer diameter B (mm), and the metal halide lamp consumes P (W) of power, the following relationships are satisfied: $0.06P+15.8 \leqq A \leqq 25$, $0.05P+9.0 \leqq B$, and $1.14 \leqq A/B$, where P satisfies $20\ W \leqq P \leqq 130\ W$.

EFFECTS OF THE INVENTION

The present invention can provide a safe and compact metal halide lamp that has desired lamp characteristics and is available as a light source to be incorporated into a bottom-surface-open-type lighting unit for spotlight, for example. Further, the present invention can provide a safe and compact lighting apparatus suitable for a spotlight, for example.

| Explanation of Letters or Numerals | |
|---|---|
| 1 | Metal halide lamp |
| 2 | Outer tube |
| 3 | Inner tube |
| 4 | Arc tube |
| 5 | Base |
| 6 | Closed portion |
| 7 | Open portion |
| 8, 11 | Straight tube portion |
| 9 | Tip-off portion |
| 10 | Sealing portion |
| 12 | Main tube portion |
| 13 | Thin tube portion |
| 14 | Envelope |
| 15 | Sealant |
| 16, 17 | Power supply wire |
| 18 | Metal foil |
| 19 | External lead wire |
| 20 | Shell portion |
| 21 | Eyelet portion |
| 22 | Base insulating portion |
| 23 | Base connecting portion |
| 24 | Cement |
| 25 | Insulating portion |
| 28 | Lighting unit |

DESCRIPTION OF THE INVENTION

Preferably, in an example of the metal halide lamp according to the present invention, assuming that the arc tube has a maximum outer diameter C (mm), the following relationship is satisfied: $0.05P+2.2 \leqq C \leqq 0.07P+5.8$.

Preferably, in an example of the metal halide lamp according to the present invention, the inner tube is filled with nitrogen gas with a nitrogen gas pressure of 20 kPa or more when a temperature in the inner tube is 25° C.

An example of a lighting apparatus according to the present invention includes: a bottom-surface-open-type lighting unit; and the metal halide lamp according to the present invention that is mounted in the lighting unit.

Hereinafter, embodiments of the present invention will be described with reference to the drawings.

Embodiment 1

Figure 1:
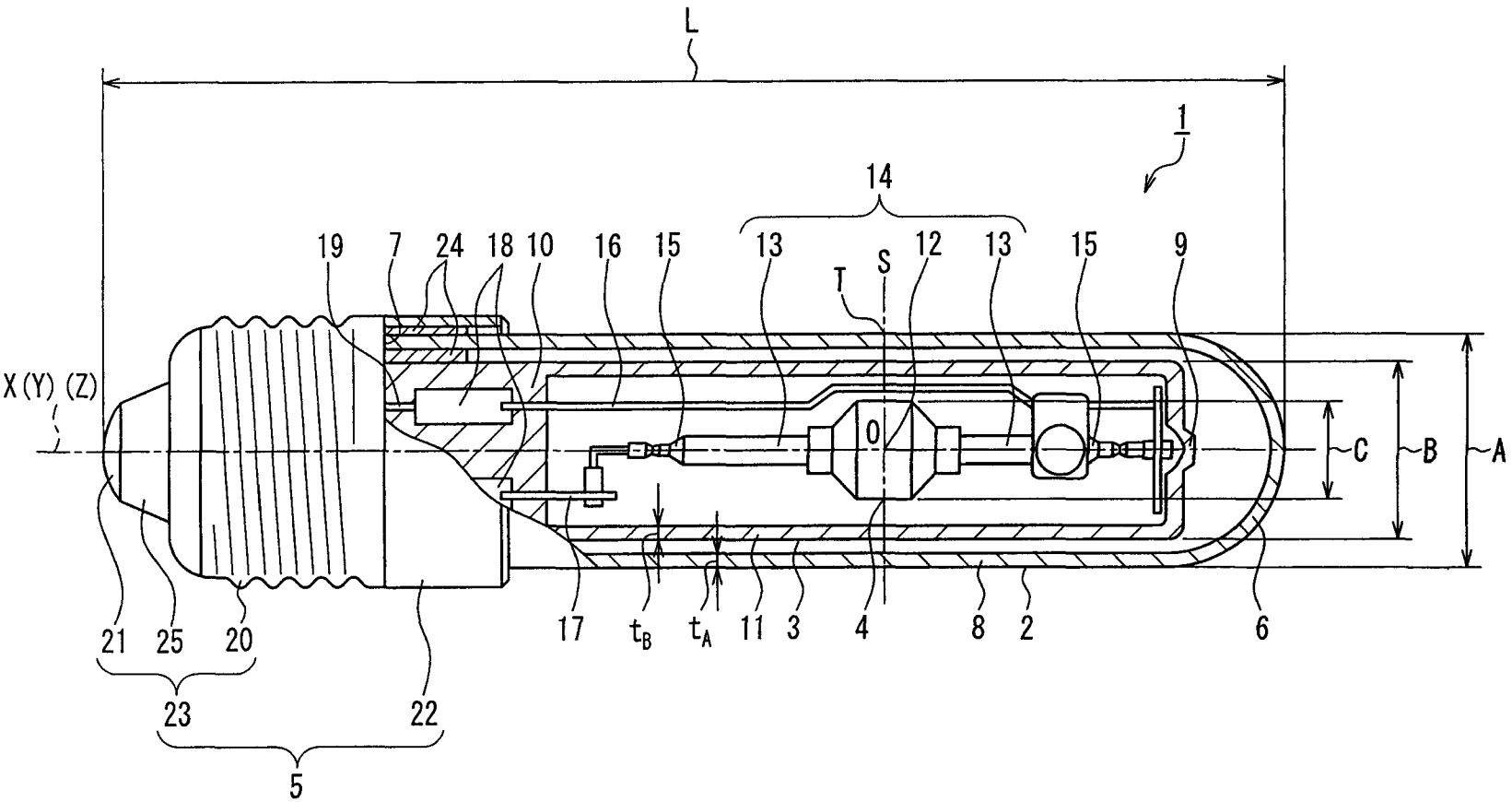
FIG. 1 is a partially cut-away front view showing an example of a metal halide lamp according to Embodiments 1 and 2.

A metal halide lamp according to Embodiment 1 is a lamp that consumes 70 W of power. The metal halide lamp (hereinafter, also referred to simply as a "lamp") of Embodiment 1 has an entire length L of 100 mm to 110 mm. The entire length L of a metal halide lamp 1 shown in FIG. 1 is 105 mm, for example. The metal halide lamp 1 includes an outer tube 2, an inner tube 3 provided in the outer tube 2, an arc tube 4 provided in the inner tube 3, and a base 5 attached to one end portion of the outer tube 2. The inner tube 3 has a sealing portion 10 in at least one end portion and is made of quartz glass.

A longitudinal central axis X of the outer tube 2, a longitudinal central axis Y of the inner tube 3, and a longitudinal central axis Z of the arc tube 4 are substantially coaxial. Here, "substantially coaxial" refers to not only the case where the central axes X, Y, and Z are exactly coaxial, but also the case where, for example, at least one of the central axes X, Y, and Z slightly deviates from the others due to variations caused when the lamp is assembled, and the like.

The outer tube 2 has a closed portion 6 with, for example, a substantially hemispherical shape in one end portion thereof, and has an open portion 7 in the other end portion. A straight tube portion 8 of the outer tube 2 has a substantially cylindrical shape and is made of hard glass such as, for example, borosilicate glass (strain point: 510° C.). Here, "substantially cylindrical shape" refers to not only the case where a cross section orthogonal to the central axis X has a circular contour, but also the case where the cross section has a non-circular contour due to variations in glass processing or the like or an elliptical contour.

Assuming that the lamp consumes P (W) of power, the outer tube 2 has a maximum outer diameter A (mm) set so as to satisfy the following relationship for the reasons described below: $0.06P+15.8 \leqq A \leqq 25$. Preferably, the outer tube 2 has a thickness $t_A$ set within a range of, for example, 1.0 mm to 2.0 mm in view of shock resistance, cost reduction, processability, and weight reduction. If the thickness $t_A$ is too small, the outer tube 2 may be damaged when a large external shock is applied thereto before assembly into the lamp (for example, during transport or the like). On the other hand, if the thickness $t_A$ is too large, the cost and the weight of the outer tube 2 are increased. If the weight of the outer tube 2 becomes higher, a greater shock is applied to the lamp when it is dropped, for example. As a result, a part of the sealing portion 10 of the inner tube 3 that is fixed by means of cement 24 (described later) may be damaged, or a thin tube portion 13 of the arc tube 4 may be broken. Further, it may become difficult to form the closed portion 6.

The pressure in the outer tube 2 is equal to atmospheric pressure, for example.

The inner tube 3 has the sealing portion 10 formed of, for example, a collapsed open end portion in one end portion thereof, and has a tip-off portion 9 as a remaining part of an exhaust pipe (not shown) in the other end portion. A straight tube portion 11 of the inner tube 3 has a substantially cylindrical shape and is made of quartz glass (strain point: 1070° C.) with an ultraviolet protection property, for example. Here, "substantially cylindrical" is synonymous with that used for the straight tube portion 8 of the outer tube 2.

Assuming that the lamp consumes P (W) of power, the inner tube 3 has a maximum outer diameter B set so as to satisfy the following relationships for the reasons described below: $0.05P+9.0 \leqq B$ and $1.14 \leqq A/B$.

Preferably, the inner tube 3 has a thickness $t_B$ set within a range of, for example, 1.0 mm to 2.0 mm in view of shock resistance, cost reduction, processability (in particular, processability concerning the formation of the sealing portion 10), and weight reduction, as in the case of the outer tube 2. If the thickness $t_B$ is too small, the inner tube 3 may be damaged when a large external shock is applied thereto before assembly into the lamp (for example, during transport or the like). On the other hand, if the thickness $t_B$ is too large, the cost is increased, and it may become difficult to form the sealing portion 10.

The inner tube 3 is sealed hermetically, and a space inside the inner tube 3 is maintained under vacuum (degree of vacuum: $10^{-3}$ Pa to $10^{-2}$ Pa) or is filled with inert gas such as nitrogen gas, for example. In the example shown in FIG. 1, the inner tube 3 is filled with nitrogen gas with a nitrogen gas pressure of, preferably, 20 kPa or more when the temperature in the inner tube 3 is 25° C. With a gas pressure of 20 kPa or more at an atmospheric temperature of 25° C., the nitrogen gas is allowed to be convected through the inner tube 3 (the space between the inner tube 3 and the arc tube 4), preventing the arc tube 4 from becoming too hot. As a result, the vapor pressure of a light emitting metal filled in the arc tube 4 can be maintained appropriately. There is no particular limitation on the lower limit of the gas pressure, but it is preferable in general that the gas pressure is 60 kPa or more when the temperature in the inner tube 3 is 25° C. Here, the "temperature in the inner tube 3" is equal to the temperature of an atmosphere in which the inner tube 3 is placed when the inert gas such as nitrogen gas is filled into the inner tube 3. Accordingly, when the temperature of this atmosphere is 25° C., the "temperature in the inner tube 3" is also 25° C.

In the example shown in FIG. 1, the inner tube 3 has the sealing portion 10 in one end portion, and has the tip-off portion 9 in the other end portion. However, the structure of the inner tube 3 is not limited thereto, and the inner tube 3 may have a structure in which both the end portions are sealed with their open end portions collapsed.

The arc tube 4 includes an envelope 14 having a main tube portion 12 and a pair of thin tube portions 13 connected to both end portions of the main tube portion 12. The envelope 14 is made of translucent ceramic such as polycrystalline alumina, for example. Examples of translucent ceramic include yttrium aluminum garnet (YAG), yttrium oxide ($Y_2O_3$), aluminum nitride, and the like.

Assuming that the lamp consumes P (W) of power, the arc tube 4 preferably has a maximum outer diameter C (i.e., the maximum outer diameter C of the main tube portion 12) set so as to satisfy the following relationship for the reasons described below: $0.05P+2.2 \leqq C \leqq 0.07P+5.8$. In the example shown in FIG. 1, the arc tube 4 includes the envelope that is obtained by integrating the main tube portion 12 and the pair of thin tube portions 13, each being molded individually, by shrinkage fitting or the like. However, the shape, the structure, and the like of the arc tube 4 are not limited to those shown in FIG. 1. For example, the arc tube 4 may include an envelope formed of a main tube portion and thin tube portions molded integrally, or may have other well-known shapes and structures. The main tube portion 12 is provided with a pair of electrodes (not shown) therein, and is filled with predetermined amounts of a metal halide, inert gas, and mercury, respectively. As the metal halide, sodium iodide, dysprosium iodide, or the like is used, for example. The distance between the electrodes is 4.0 mm to 7.0 mm, for example.

In each of the thin tube portions 13, a feeder (not shown) mounted with an electrode in one end portion is inserted. The feeder is made of a conductive cermet, for example. A part of the feeder is adhered to the thin tube portion 13 by means of a sealant 15 of frit, but another part of the feeder in the thin tube portion 13 is spaced apart from the thin tube portion 13.

The end portion (the other end portion) of the feeder that is opposite to the one end portion in which the electrode is mounted protrudes from the thin tube portion 13, and the pair of feeders are connected to power supply wires 16 and 17, respectively. The power supply wire 16 is connected to an external lead wire 19 via metal foil 18 sealed in the sealing portion 10, and the power supply wire 17 is connected to another external lead wire (not shown) via another metal foil 18 also sealed in the sealing portion 10. The external lead wire 19 is connected to a shell portion 20 of the base 5, and the other external lead wire (not shown) is connected to an eyelet portion 21 of the base 5.

Each of the power supply wires 16 and 17 may be formed of a single metal wire or of a plurality of integrated metal wires connected to each other.

The base 5 has a base insulating portion 22 made of ceramic such as steatite, and an E-type base connecting portion 23. The base connecting portion 23 is connected electrically to a socket (not shown) of a lighting unit when inserted into the socket.

The base insulating portion 22 has a cup shape. In the base insulating portion 22, the open portion 7 of the outer tube 2 and the sealing portion 10 of the inner tube 3 are inserted, and the inner tube 3 is fixed firmly to the outer tube 2 and the outer tube 2 is fixed firmly to the base insulating portion 22 by means of cement 24 having heat resistance to 1000° C. or more, for example.

The base connecting portion 23 has the shell portion 20 and the eyelet portion 21 provided on the shell portion 20 via an insulating portion 25. The base 5 is not limited to that shown in FIG. 1, and may have other well-known shapes and structures. For example, the base connecting portion 23 may be of a pin-shaped PG-type or G-type instead of the E-type. Further, there is no particular limitation on the material of the base 5, and a well-known material can be used.

Embodiment 2

Next, a metal halide lamp according to Embodiment 2 will be described. The metal halide lamp of Embodiment 2 is a lamp that consumes 20 W of power.

The metal halide lamp of Embodiment 2 has the same basic structure as that of the metal halide lamp of Embodiment 1 except mainly for its dimensions. The following description is directed to its main dimensions with reference also to FIG. 1.

The metal halide lamp of Embodiment 2 has an entire length L of 85 mm to 105 mm (for example, 95 mm). Assuming that the lamp consumes P (W) of power, the outer tube 2 has a maximum outer diameter A (mm) set so as to satisfy the following relationship for the reasons described below: $0.06P+15.8 \leqq A \leqq 25$. Preferably, the outer tube 2 has a thickness $t_A$ set within a range of, for example, 1.0 mm to 2.0 mm in view of shock resistance, cost reduction, processability (in particular, processability concerning the formation of the closed portion 6), and weight reduction as mentioned above. Assuming that the lamp consumes P (W) of power, the inner tube 3 has a maximum outer diameter B set so as to satisfy the following relationships for the reasons described below: $0.05P+9.0 \leqq B$ and $1.14 \leqq A/B$. Preferably, the inner tube 3 has a thickness $t_B$ set within a range of, for example, 1.0 mm to 2.0 mm in view of shock resistance, cost reduction, processability (in particular, processability concerning the formation of the sealing portion 10), and weight reduction. Assuming that the lamp consumes P (W) of power, the arc tube 4 preferably has a maximum outer diameter C (i.e., the maximum outer diameter C of the main tube portion 12) set so as to satisfy the following relationship for the reasons described below: $0.05P+2.2 \leqq C \leqq 0.07P+5.8$. The distance between a pair of electrodes is 2 mm to 4 mm, for example.

Next, a description will be given of the reasons why the metal halide lamps of Embodiments 1 and 2 are designed to satisfy the relationships $0.06P+15.8 \leqq A \leqq 25$, $0.05P+9.0 \leqq B$, and $1.14 \leqq A/B$.

Initially, with respect to the lamp of Embodiment 1 (power consumption: 70 W) and the lamp of Embodiment 2 (power consumption: 20 W), the maximum outer diameter A (mm) of the outer tube 2 was changed variously as shown in Table 1. Ten samples were manufactured for each lamp.

Each of the manufactured lamps was lighted as usual with a well-known copper-iron ballast, and the surface temperature (° C.) of the outer tube 2 at stable lighting was examined. The results are shown in Table 1.

In the lamps that consumed 70 W of power, the outer tube 2 had a thickness $t_A$ of 1.5 mm, the inner tube 3 had a thickness $t_B$ of 1.25 mm and a maximum outer diameter B of 13 mm, and the main tube portion 12 had a maximum outer diameter C of 9.5 mm. On the other hand, in the lamps that consumed 20 W of power, the outer tube 2 had a thickness $t_A$ of 1.5 mm, the inner tube 3 had a thickness $t_B$ of 1.25 mm and a maximum outer diameter B of 10 mm, and the main tube portion 12 had a maximum outer diameter C of 5.2 mm.

The surface temperature of the outer tube 2 was measured in a state where the bare lamp was lighted horizontally. The point of temperature measurement was an intersection point T, which was an upper point of intersection of a vertical line S drawn from a center point O between the pair of electrodes and an outer surface of the outer tube 2. At this time, a surrounding atmosphere was at room temperature (25° C.). The surface temperature was measured with a thermocouple formed of K (CA) lines having a diameter of 0.2 mm. The surface temperature of the outer tube 2 was evaluated as favorable in the case of 420° C. or less and as unfavorable in the case of more than 420° C. This criterion is based on the following empirical rule of the inventors. That is, when the surface temperature of the outer tube 2 is lower than the strain point (510° C.) of hard glass used as a material of the outer tube 2 by 90° C. or more, no outer tube 2 is heated to a temperature exceeding the strain point and is deformed to have a defective appearance during lighting under a harsh environment of actual use in the market.

TABLE 1

| | Power consumption P (W) | Maximum outer diameter A of outer tube (mm) | Maximum outer diameter B of inner tube (mm) | A/B | Surface temperature of outer tube (° C.) | Evaluation |
|---|---|---|---|---|---|---|
| Ex. 1 | 70 | 20 | 13 | 1.54 | 420 | Favorable |
| Ex. 2 | 70 | 21 | 13 | 1.62 | 405 | Favorable |
| Com. Ex. 1 | 70 | 19 | 13 | 1.46 | 435 | Unfavorable |
| Ex. 3 | 20 | 17 | 10 | 1.70 | 415 | Favorable |
| Ex. 4 | 20 | 18 | 10 | 1.80 | 400 | Favorable |
| Com. Ex. 2 | 20 | 16 | 10 | 1.60 | 425 | Unfavorable |

As shown in Table 1, with respect to the lamp that consumed 70 W of power, when the maximum outer diameter A of the outer tube 2 was 20 mm or more as in Examples 1 and 2, the surface temperature of the outer tube 2 was favorable. Further, with respect to the lamp that consumed 20 W of power, when the maximum outer diameter A of the outer tube 2 was 17 mm or more as in Examples 3 and 4, the surface temperature of the outer tube 2 was favorable.

On the other hand, with respect to the lamp that consumed 70 W of power, when the maximum outer diameter A of the outer tube 2 was 19 mm or less as in Comparative Example 1, the surface temperature of the outer tube 2 was unfavorable. Further, with respect to the lamp that consumed 20 W of power, when the maximum outer diameter A of the outer tube 2 was 16 mm or less as in Comparative Example 2, the surface temperature of the outer tube 2 was unfavorable.

The reason for these results is believed to be as follows.

With respect to the lamps of Comparative Examples 1 and 2, it is believed that the maximum outer diameter A of the outer tube 2 was too small, so that the outer tube 2 got too close to an arc in the arc tube 4 during lighting, whereby the temperature of the outer tube 2 was increased excessively by heat from the arc. When the temperature of the outer tube 2 is increased excessively as above, the outer tube 2 may be deformed to have a defective appearance. On the other hand, with respect to the lamps of Examples 1 to 4, it is believed that an adequate distance was kept between the arc in the arc tube 4 and the outer tube 2, whereby the temperature of the outer tube 2 was not increased excessively.

It was found that the maximum outer diameter A of the outer tube 2 should be 25 mm or less, taking into consideration the ability of the lamp to fit in a commercially available bottom-surface-open-type lighting unit for spotlight.

From the above-mentioned results, it was found that, assuming the lamp consumed P (W) of power, the maximum outer diameter A (mm) of the outer tube 2 should satisfy the relationship $0.06P+15.8 \leqq A \leqq 25$ so as to (1) avoid deformation of the outer tube 2 due to an abnormally increased temperature thereof during lighting and prevent a defective appearance due to such deformation, and to (2) achieve a compact lamp to increase, in particular, the fitness for a bottom-surface-open-type lighting unit for spotlight.

However, it was found that when the lamp consumed higher power P, there was a remarkable increase in the amount of heat emitted from the arc tube 4 during lighting, and the effects (1) and (2) were not achieved sufficiently even when the above-mentioned relationship was satisfied. To avoid this, a study was made on a range of the power consumption P that allows the above-mentioned effects to be achieved sufficiently. As a result, it was found that the power consumption should be 130 W or less, practically, 20 W to 130 W.

When the maximum outer diameter B of the inner tube 3 was changed variously, some lamps went out even when the maximum outer diameter A of the outer tube 2 satisfied the above relationship.

In order to examine in detail the cause of the lamp going out, with respect to the lamp of Embodiment 1 (power consumption: 70 W) and the lamp of Embodiment 2 (power consumption: 20 W), the maximum outer diameter A (mm) of the outer tube 2 and the maximum outer diameter B (mm) of the inner tube 3 were changed variously as shown in Table 2. Ten samples were manufactured for each lamp.

Then, each of the manufactured lamps was lighted as usual with a well-known copper-iron ballast for 5.5 hours, followed by extinction for 0.5 hours. This cycle was repeated, and the rate at which the lamp went out before a total lighting time of 3000 hours was examined. The results are shown in Table 2.

In the lamps that consumed 70 W of power, the outer tube 2 had a thickness $t_A$ of 1.5 mm, the inner tube 3 had a thickness $t_B$ of 1.25 mm, and the main tube portion 12 had a maximum outer diameter C of 9.5 mm. On the other hand, in the lamps that consumed 20 W of power, the outer tube 2 had a thickness $t_A$ of 1.5 mm, the inner tube 3 had a thickness $t_B$ of 1.25 mm, and the main tube portion 12 had a maximum outer diameter C of 5.2 mm.

TABLE 2

| | Power consumption P (W) | Maximum outer diameter A of outer tube (mm) | Maximum outer diameter B of inner tube (mm) | A/B | Rate of lamp going out | Evaluation |
|---|---|---|---|---|---|---|
| Ex. 1 | 70 | 20 | 13 | 1.54 | 0/10 | Favorable |
| Ex. 5 | 70 | 20 | 17 | 1.18 | 0/10 | Favorable |
| Ex. 6 | 70 | 25 | 13 | 1.92 | 0/10 | Favorable |
| Ex. 7 | 70 | 25 | 14 | 1.79 | 0/10 | Favorable |
| Com. Ex. 3 | 70 | 20 | 12 | 1.67 | 4/10 | Unfavorable |
| Com. Ex. 4 | 70 | 25 | 12 | 2.08 | 4/10 | Unfavorable |
| Ex. 3 | 20 | 17 | 10 | 1.70 | 0/10 | Favorable |
| Ex. 8 | 20 | 17 | 11 | 1.55 | 0/10 | Favorable |
| Ex. 9 | 20 | 17 | 14 | 1.21 | 0/10 | Favorable |
| Ex. 10 | 20 | 25 | 10 | 2.50 | 0/10 | Favorable |
| Com. Ex. 5 | 20 | 17 | 9 | 1.89 | 4/10 | Unfavorable |
| Com. Ex. 6 | 20 | 25 | 9 | 2.78 | 3/10 | Unfavorable |

In the column of "Rate of lamp going out" in Table 2, each denominator represents the total number of samples, and each numerator represents the number of samples that went out.

As shown in Table 2, it was found that when the maximum outer diameter B of the inner tube 3 was 13 mm or more in the lamp that consumed 70 W of power as in Examples 1, 5, 6, and 7, and when the maximum outer diameter B of the inner tube 3 was 10 mm or more in the lamp that consumed 20 W of power as in Examples 3, 8, 9, and 10, no sample went out even after a total lighting time of 3000 hours.

On the other hand, it was found that when the maximum outer diameter B of the inner tube 3 was 12 mm or less in the lamp that consumed 70 W of power as in Comparative Examples 3 and 4, and when the maximum outer diameter B of the inner tube 3 was 9 mm or less in the lamp that consumed 20 W of power as in Comparative Examples 5 and 6, three or four out of ten samples went out before the elapse of a total lighting time of 3000 hours.

The reason for these results is believed to be as follows.

In the lamps of Comparative Examples 3, 4, 5, and 6, the maximum outer diameter B of the inner tube 3 was too small, so that a heat retaining effect of the inner tube 3 on the arc tube 4 was increased abnormally during lighting, resulting in an excessive increase in temperature of the arc tube 4. As a result, a light emitting metal filled in the arc tube 4 reacted with the ceramic composing the envelope 14 of the arc tube 4, and excessive halogen was produced in a discharge space. Then, free halogen captured electrons and made them disappear during lighting, causing the restriking voltage to be increased. This is believed to be the reason why the lamps went out. On the other hand, with respect to the lamps of Examples 1, 3, 5, 6, 7, 8, 9, and 10, it is believed that the heat retaining effect of the inner tube 3 on the arc tube 4 during lighting was appropriate, and thus the temperature of the arc tube 4 was not increased excessively.

From the above-mentioned results, it was found that, assuming the lamp consumed P (W) of power, the maximum outer diameter B (mm) of the inner tube 3 should satisfy at least the relationship $0.05P+9.0 \leqq B$ so as to restrain the lamp from going out due to a reaction between the ceramic composing the envelope 14 of the arc tube 4 and the light emitting metal filled in the arc tube 4. Further, it was confirmed that in the case where the power consumption P of the lamp was not less than 20 W and not more than 130 W, a sufficient effect was obtained for restraining the lamp from going out when the above relationship was satisfied.

However, when the maximum outer diameter B of the inner tube 3 was made larger, there arose an unexpected problem that the outer tube 2 was damaged due to destruction of the arc tube 4.

In order to examine in detail the cause of the damage to the outer tube 2, with respect to the lamp of Embodiment 1 (power consumption: 70 W) and the lamp of Embodiment 2 (power consumption: 20 W), the maximum outer diameter A (mm) of the outer tube 2 and the maximum outer diameter B (mm) of the inner tube 3 were changed variously as shown in Table 3. Ten samples were manufactured for each lamp.

Then, a lamp current that was several times to several tens of times higher than a usual lamp current flowing at stable lighting was allowed to flow through each of the manufactured lamps by using a well-known copper-iron ballast. The lamp was lighted in an overloaded condition in this manner, so that the arc tube 4 was destroyed forcibly. The rate at which the outer tube 2 was damaged was examined. The results are shown in Table 3.

In the lamps that consumed 70 W of power, the outer tube 2 had a thickness $t_A$ of 1.5 mm, the inner tube 3 had a thickness $t_B$ of 1.25 mm, and the main tube portion 12 had a maximum outer diameter C of 9.5 mm. On the other hand, in the lamps that consumed 20 W of power, the outer tube 2 had a thickness $t_A$ of 1.5 mm, the inner tube 3 had a thickness $t_B$ of 1.25 mm, and the main tube portion 12 had a maximum outer diameter C of 5.2 mm.

TABLE 3

| | Power consumption P (W) | Maximum outer diameter A of outer tube (mm) | Maximum outer diameter B of inner tube (mm) | A/B | Rate of damage to outer tube | Evaluation |
|---|---|---|---|---|---|---|
| Ex. 1 | 70 | 20 | 13 | 1.54 | 0/10 | Favorable |
| Ex. 5 | 70 | 20 | 17 | 1.18 | 0/10 | Favorable |
| Ex. 11 | 70 | 25 | 22 | 1.14 | 0/10 | Favorable |
| Com. Ex. 7 | 70 | 20 | 18 | 1.11 | 3/10 | Unfavorable |
| Com. Ex. 8 | 70 | 25 | 23 | 1.09 | 3/10 | Unfavorable |
| Ex. 3 | 20 | 17 | 10 | 1.70 | 0/10 | Favorable |
| Ex. 9 | 20 | 17 | 14 | 1.21 | 0/10 | Favorable |
| Ex. 12 | 20 | 25 | 22 | 1.14 | 0/10 | Favorable |
| Com. Ex. 9 | 20 | 17 | 15 | 1.13 | 2/10 | Unfavorable |
| Com. Ex. 10 | 20 | 25 | 23 | 1.09 | 3/10 | Unfavorable |

In the column of "Rate of damage to outer tube" in Table 3, each denominator represents the total number of samples, and each numerator represents the number of samples in which the outer tube 2 was damaged.

As shown in Table 3, in the lamps of Examples 1, 3, 5, 9, 11, and 12, the maximum outer diameter B of the inner tube 3 is not so large relative to the maximum outer diameter A of the outer tube 2. For example, the ratio (A/B) of the maximum outer diameter A of the outer tube 2 to the maximum outer diameter B of the inner tube 3 is 1.14 or more. In these lamps, the outer tube 2 was not damaged even if the arc tube 4 was destroyed.

On the other hand, in the lamps of Comparative Examples 7, 8, 9, and 10, the maximum outer diameter B of the inner tube 3 is large, and the ratio (A/B) of the maximum outer diameter A of the outer tube 2 to the maximum outer diameter B of the inner tube 3 is 1.13 or less. In these lamps, when the arc tube 4 was destroyed, the outer tube 2 also was damaged due to the destruction of the arc tube 4.

The reason for these results is believed to be as follows.

In the lamps of Comparative Examples 7, 8, 9, and 10, the outer tube 2 and the inner tube 3 were close to each other since the maximum outer diameter B of the inner tube 3 was large. Therefore, due to destruction of the arc tube 4, the inner tube 3 also was damaged, and the outer tube 2, to which a great shock was applied directly by flying pieces of the inner tube 3, also was damaged. This is believed to be the reason for the damage to the outer tube 2. On the other hand, with respect to the lamps of Examples 1, 3, 5, 9, 11, and 12, it is believed that even if the inner tube 3 was damaged due to destruction of the arc tube 4, the outer tube 2 was not subjected to a great shock by flying pieces of the inner tube 3 since an adequate distance was kept between the outer tube 2 and the inner tube 3.

From the above, it was found that the relationship $A/B \geqq 1.14$ should be satisfied so as to prevent damage to the outer tube 2 caused by destruction of the arc tube 4.

The maximum outer diameter B of the inner tube 3 is preferably larger in order to restrain the lamp from going out, and is preferably smaller in order to prevent damage to the outer tube 2 caused by destruction of the arc tube 4. It was found from the results shown in Tables 2 and 3 that there was a range in which the condition for restraining the lamp from going out and the condition for preventing damage to the outer tube 2 are both satisfied.

Further, the lamp characteristics were measured with respect to the lamps of all the examples above. Each of the lamps had an initial emitted luminous flux of 6000 lm or more, an luminous efficiency of 80 lm/W, and a luminous flux maintenance factor of 70% or more at a total lighting time of 6000 hours. It was confirmed that the lamps were comparable to a conventional metal halide lamp and had the desired lamp characteristics. Here, "initial emitted luminous flux" refers to an emitted luminous flux at a total lighting time of 100 hours. Further, "luminous flux maintenance factor" refers to a percentage based on the emitted luminous flux at a total lighting time of 100 hours taken as 100.

As described above, assuming that the outer tube 2 has a maximum outer diameter A (mm), the inner tube 3 has a maximum outer diameter B (mm), and the lamp consumes P (W) of power (where $20\ W \leqq P \leqq 130\ W$), when the relationships $0.06P+15.8 \leqq A \leqq 25$, $0.05P+9.0 \leqq B$. and $1.14 \leqq A/B$ are satisfied, it is possible to provide a compact lamp with the desired lamp characteristics in which (1) deformation of the outer tube 2 due to an excessively increased temperature thereof is suppressed, (2) the lamp is restrained from going out due to an excessively increased temperature of the arc tube 4, and (3) damage to the outer tube 2 caused by destruction of the arc tube 4 is suppressed. This lamp is suitable, in particular, for use with a bottom-surface-open-type lighting unit.

On the assumption that the above three relationships are satisfied, it is more preferable that the arc tube 4 has a maximum outer diameter C (mm) that satisfies the relationship $0.05P+2.2 \leqq C \leqq 0.07P+5.8$ (where $20\ W \leqq P \leqq 130\ W$). The reason for this is described below.

Initially, with respect to the lamp of Embodiment 1 (power consumption: 70 W) and the lamp of Embodiment 2 (power consumption: 20 W), the maximum outer diameter C of the arc tube 4 was changed variously as shown in Table 4. Ten samples were manufactured for each lamp. The distance between the electrodes and a longitudinal dimension of the arc tube 4 were unchanged. Accordingly, the bulb wall loading (electrical input per unit area of a bulb wall of the lamp) decreased, and the vapor pressure of the light emitting metal was reduced, resulting in a decrease in lamp voltage. To ensure a usual lamp voltage (90 V), each sample was filled with mercury in an amount adjusted as appropriate. In general, a larger amount of mercury is required to be filled to increase the lamp voltage.

Then, each of the manufactured lamps was lighted as usual with a well-known copper-iron ballast, and a color temperature variation (difference) $\Delta T_C$ (K) between the color temperature at vertical lighting and the color temperature at horizontal lighting was examined. Further, a lamp current that was several times to several tens of times higher than a usual lamp current flowing at stable lighting was allowed to flow through each of the lamps. The lamp was lighted in an overloaded condition in this manner, so that the arc tube 4 was destroyed forcibly. The rate at which the outer tube 2 was damaged was examined. The results are shown in Table 4.

In the lamps that consumed 70 W of power, the outer tube 2 had a maximum outer diameter A of 20 mm and a thickness $t_A$ of 1.5 mm, the inner tube 3 had a maximum outer diameter B of 13 mm and a thickness $t_B$ of 1.25 mm, the envelope 14 had an entire length L of 39 mm, and the distance between the electrodes was 5.0 mm. On the other hand, in the lamps that consumed 20 W of power, the outer tube 2 had a maximum outer diameter A of 20 mm and a thickness $t_A$ of 1.5 mm, the inner tube 3 had a maximum outer diameter B of 10 mm and a thickness $t_B$ of 1.25 mm, the envelope 14 had an entire length L of 30 mm, and the distance between the electrodes was 2.5 mm.

The stability of color temperature was evaluated as favorable when the color temperature variation $\Delta T_C$ (K) was 300 K or less and as unfavorable when the color temperature variation $\Delta T_C$ (K) was more than 300 K. When the color temperature variation $\Delta T_C$ (K) is 300 K or less, it cannot be perceived visually. The color temperature was measured with a color temperature meter (MCPD-1000 manufactured by Otsuka Electronics Co., Ltd.).

In the column of "Rate of damage to outer tube" in Table 4, each denominator represents the total number of samples, and each numerator represents the number of samples in which the outer tube 2 was damaged.

TABLE 4

| | Power consumption P (W) | Maximum outer diameter C of arc tube (mm) | Color temperature variation $\Delta T_C$ (K) | Rate of damage to outer tube | Evaluation |
|---|---|---|---|---|---|
| Ex. 13 | 70 | 5.7 | 300 | 0/10 | Favorable |
| Ex. 14 | 70 | 10.7 | 180 | 0/10 | Favorable |
| Com. Ex. 11 | 70 | 5.2 | 350 | 0/10 | Unfavorable |
| Com. Ex. 12 | 70 | 11.0 | 170 | 3/10 | Unfavorable |
| Ex. 15 | 20 | 3.2 | 300 | 0/10 | Favorable |
| Ex. 16 | 20 | 7.2 | 240 | 0/10 | Favorable |
| Com. Ex. 13 | 20 | 2.8 | 380 | 0/10 | Unfavorable |
| Com. | 20 | 7.5 | 230 | 4/10 | Unfavorable |

TABLE 4-continued

| | Power consumption P (W) | Maximum outer diameter C of arc tube (mm) | Color temperature variation $\Delta T_C$ (K) | Rate of damage to outer tube | Evaluation |
|---|---|---|---|---|---|
| Ex. 14 | | | | | |

As shown in Table 4, the maximum outer diameter C of the arc tube 4 was 5.7 mm or more in the lamps of Examples 13, 14, and Comparative Example 12 that consumed 70 W of power, and the maximum outer diameter C of the arc tube 4 was 3.2 mm or more in the lamps of Examples 15, 16, and Comparative Example 14 that consumed 20 W of power. These lamps had a small color temperature variation $\Delta T_C$ (K) of 300 K or less, exhibiting favorable stability of the color temperature.

On the other hand, the maximum outer diameter C of the arc tube 4 was 5.2 mm or less in the lamps of Comparative Example 11 that consumed 70 W of power, and the maximum outer diameter C of the arc tube 4 was 2.8 mm or less in the lamps of Comparative Example 13 that consumed 20 W of power. These lamps had a large color temperature variation $\Delta T_C$ (K), exhibiting unfavorable stability of the color temperature.

The reason for these results is believed to be as follows.

In general, when the lamp is lighted vertically, the coldest point that determines the vapor pressure of the light emitting metal is formed on a bottom surface among inner surfaces of the main tube portion 12 or in the thin tube portion 13 located on a lower side in a state where the lamp is set vertically. On the other hand, when the lamp is lighted horizontally, the coldest point is formed on the bottom surface among the inner surfaces of the main tube portion 12 in a state where the lamp is set horizontally.

The following phenomenon is believed to occur in the lamps of Comparative Examples 11 and 13.

In the lamps of Comparative Examples 11 and 13, the maximum outer diameter C of the arc tube 4 is too small. Thus, in the case of horizontal lighting, the coldest point gets close to the arc, and the temperature at this point increases, whereby the vapor pressure of the light emitting metal is increased remarkably. On the other hand, in the case of vertical lighting, even if the maximum outer diameter C of the arc tube 4 is small, the vapor pressure of the light emitting metal is not increased remarkably since an adequate distance is kept between the coldest point and the arc. In this manner, in the lamps of Comparative Examples 11 and 13, the vapor pressure of the light emitting metal is different between vertical lighting and horizontal lighting, which is believed to be the reason for a large color temperature variation.

On the other hand, in the lamps of Examples 13, 14, 15, 16, Comparative Examples 12 and 14, since the maximum outer diameter C of the arc tube 4 is sufficiently large, the coldest point does not get so close to the arc as to increase the temperature at this point and cause a remarkable increase in the vapor pressure of the light emitting metal. This is believed to be the reason for a small color temperature variation.

From the above, it was found that the maximum outer diameter C (mm) of the arc tube 4 should satisfy the relationship $0.05P+2.2 \leqq C$ so as to suppress a large color temperature variation (difference) between vertical lighting and horizontal lighting. Further, it was confirmed that also in the case where the power consumption P of the lamp was not less than 20 W and not more than 130 W, a sufficient effect was obtained for suppressing the color temperature variation when the above relationship was satisfied.

Further, it was found that as shown in Table 4, when the maximum outer diameter C of the arc tube 4 was 10.7 mm or less in the lamp that consumed 70 W of power as in Examples 13, 14, and Comparative Example 11, and when the maximum outer diameter C of the arc tube 4 was 7.2 mm or less in the lamp that consumed 20 W of power as in Examples 15, 16, and Comparative Example 13, the outer tube 2 was not damaged even if the arc tube 4 was destroyed. On the other hand, it was found that when the maximum outer diameter C of the arc tube 4 was 11.0 mm or more in the lamp that consumed 70 W of power as in Comparative Example 12, and when the maximum outer diameter C of the arc tube 4 was 7.5 mm or more in the lamp that consumed 20 W of power as in Comparative Example 14, the outer tube 2 also was damaged due to destruction of the arc tube 4.

The reason for these results is believed to be as follows.

In the lamps of Comparative Examples 12 and 14, the maximum outer diameter C of the arc tube 4 was made larger, and mercury was filled in an amount increased 10% to 35% so as to maintain the lamp voltage at a predetermined level (90 V). Consequently, the mercury vapor pressure during lighting was increased considerably, so that the shattered pieces of the arc tube 4 flew with great force. This is believed to be the cause of the damage to the outer tube 2. On the other hand, in the lamps of Examples 13, 14, 15, 16, Comparative Examples 11 and 13, only a small amount of mercury was required to be filled since the maximum outer diameter C of the arc tube 4 was not so large. Thus, it is believed that even if the arc tube 4 was destroyed, pieces thereof did not fly with such great force as to cause damage to the outer tube 2.

From the above, it was found that, assuming the lamp consumed P (W) of power, the maximum outer diameter C (mm) of the arc tube 4 should satisfy the relationship $C \leqq 0.07P+5.8$ so as to prevent reliably damage to the outer tube 2 caused by destruction of the arc tube 4. Further, it was also confirmed that in the case where the power consumption P of the lamp was not less than 20 W and not more than 130 W, it was possible to prevent reliably damage to the outer tube 2 caused by destruction of the arc tube 4 when the above relationship was satisfied.

Consequently, when the maximum outer diameter C (mm) of the arc tube 4 satisfies the relationship $0.05P+2.2 \leqq C \leqq 0.07P+5.8$, the color temperature variation between vertical lighting and horizontal lighting can be suppressed, and damage to the outer tube 2 caused by destruction of the arc tube 4 can be prevented reliably.

The lamps of each of the examples are lighted with a copper-iron ballast. However, another well-known electronic ballast may be used to light the lamps so as to achieve the same effects as in the case of using the copper-iron ballast.

Figure 2:
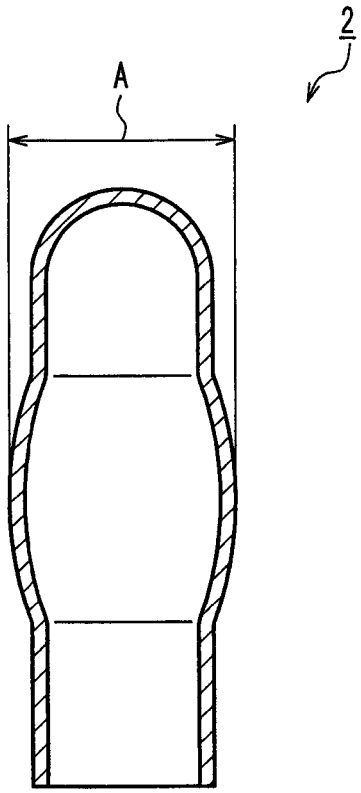
FIG. 2 is a cross-sectional front view showing an example of an outer tube constituting the metal halide lamp shown in FIG. 1.
Figure 3:
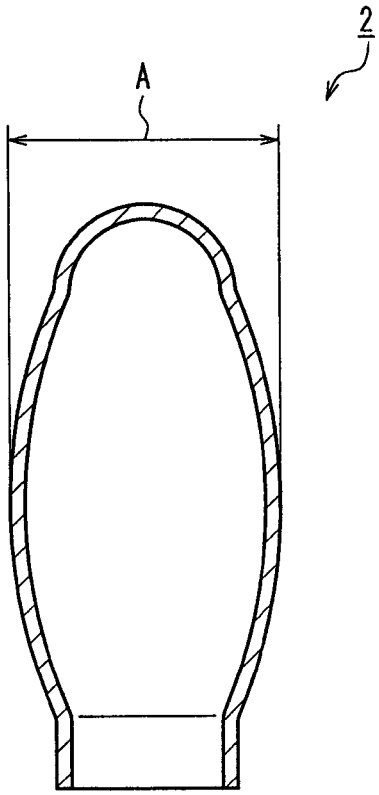
FIG. 3 is a cross-sectional front view showing another example of the outer tube constituting the metal halide lamp shown in FIG. 1.

Further, in Embodiments 1 and 2, the description has been given of the case where the outer tube 2 is a straight tube except for the one end portion as shown in FIG. 1. However, the outer tube 2 is not limited to that shown in FIG. 1, and may be one that is slightly bowed outward only at the center as shown in FIG. 2 or one that is wholly bowed outward such that the outer diameter that is largest at the center decreases gradually with increasing proximity to each end portion as shown in FIG. 3. Even with the outer tube 2 having the structure shown in FIG. 2 or 3, it is possible to achieve the same effects as those of the metal halide lamp shown in FIG. 1.

Embodiment 3

Figure 4:
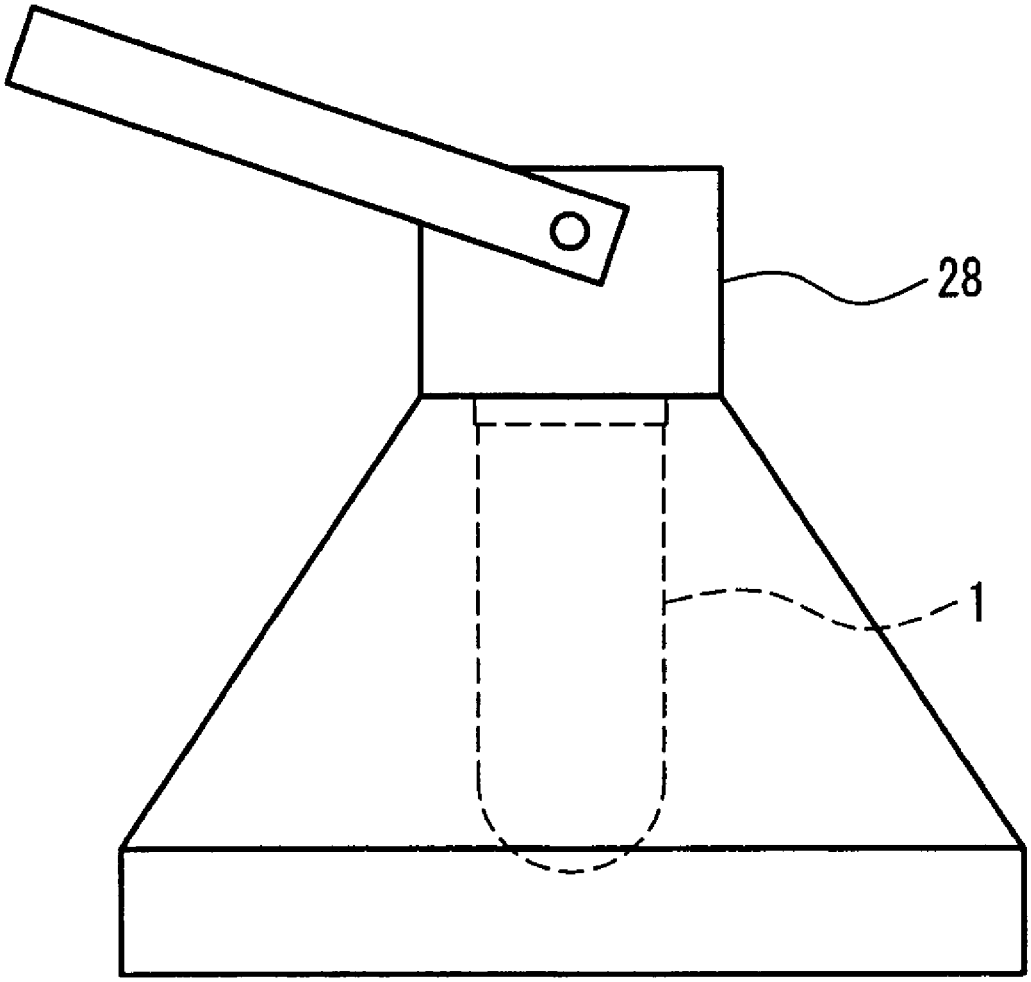
FIG. 4 is a schematic view showing an example of a lighting apparatus according to Embodiment 3.

In Embodiment 3, a description will be given of an example of a lighting apparatus using the metal halide lamp of Embodiment 1. As shown in FIG. 4, the lighting apparatus of the present embodiment includes a bottom-surface-open-type lighting unit 28 for spotlight, and a metal halide lamp 1 mounted in the lighting unit 28. The metal halide lamp 1 consumes 70 W of power.

The lighting apparatus shown in FIG. 4 is fixed to a ceiling, for example. A ballast (not shown) for lighting the metal halide lamp 1 may be fixed on the ceiling or embedded in the ceiling. Various well-known copper-iron ballasts or electronic ballasts are available as the ballast.

The lighting apparatus of the present embodiment uses as a light source the metal halide lamp 1 that ensures a high level of safety and is compact in size. Therefore, the lighting apparatus of the present embodiment can be made compact as a apparatus itself and provides a high level of safety.

In Embodiment 3, the lighting apparatus shown in FIG. 4 uses as a lighting unit the bottom-surface-open-type lighting unit 28 for spotlight. However, the lighting apparatus of the present embodiment is not limited thereto, and various other well-known lighting units may be used. Also in such a case, it is possible to achieve the same effects as those of the lighting apparatus shown in FIG. 4.

INDUSTRIAL APPLICABILITY

The metal halide lamp according to the present invention has the desired lamp characteristics, is compact in size, and provides a high level of safety. Thus, this metal halide lamp can be used in applications that require compactness and a high level of safety, for example, as a light source to be incorporated into a bottom-surface-open-type lighting unit for spot light.

The invention claimed is:

1. A metal halide lamp comprising:

an outer tube;

an inner tube made of quartz glass that is provided in the outer tube and has a sealing portion formed of a collapsed open end portion in one end portion thereof and a tip-off portion in another end portion thereof, the inner tube forming an enclosed area that has hermeticity; and an arc tube provided in the inner tube, the arc tube including an envelope made of translucent ceramic, wherein a longitudinal central axis of the outer tube, a longitudinal central axis of the inner tube, and a longitudinal central axis of the arc tube are substantially coaxial, and assuming that the outer tube has a maximum outer diameter A (mm), the inner tube has a maximum outer diameter B (mm), and the metal halide lamp consumes P (W) of power, the following relationships are satisfied:

$$0.06P+15.8<A<25,$$

$$0.05P+9.0<B, \text{ and}$$

$$1.14<A/B,$$

where P satisfies 20<P<130.

2. The metal halide lamp according to claim 1, wherein assuming that the arc tube has a maximum outer diameter C (mm), the following relationship is satisfied: 0.05P+2.2<C<0.07P+5.8.

3. The metal halide lamp according to claim 1, wherein the inner tube is filled with nitrogen gas with a nitrogen gas pressure of 20 kPa or more when a temperature in the inner tube is 25° C.

4. A lighting apparatus comprising:

a bottom-surface-open-type lighting unit; and the metal halide lamp according to claim 1 that is mounted in the lighting unit.

5. The metal halide lamp according to claim 1, wherein the envelope has a main tube portion and a pair of thin tube portions connected to both end portions of the main tube portion, in each of the thin tube portions, a feeder mounted with an electrode in one end portion is inserted, and a part of the feeder is adhered to the thin tube portion by means of a sealant of frit.

* * * * *